US008820329B2

(12) United States Patent
Haider

(10) Patent No.: US 8,820,329 B2
(45) Date of Patent: Sep. 2, 2014

(54) HANDS FREE HOOKAH MOUTH TIP

(76) Inventor: Raed Haider, Washington, DC (US)

( * ) Notice: Subject to any disclaimer, the term of this patent is extended or adjusted under 35 U.S.C. 154(b) by 0 days.

(21) Appl. No.: 13/557,572

(22) Filed: Jul. 25, 2012

(65) Prior Publication Data

US 2014/0026903 A1 Jan. 30, 2014

(51) Int. Cl.
*A24F 7/00* (2006.01)

(52) U.S. Cl.
USPC ..... 131/229; 131/187; 131/227

(58) Field of Classification Search
CPC ..... A24F 1/30; A24D 3/18
USPC ..... 131/227, 229
See application file for complete search history.

(56) References Cited

U.S. PATENT DOCUMENTS 2,135,632 A * 11/1938 Barling ..... 131/229
3,053,262 A * 9/1962 Falk ..... 131/201
4,071,036 A * 1/1978 Jacobs ..... 131/187
5,819,752 A * 10/1998 Steele ..... 131/227
6,418,937 B1 * 7/2002 Cristiano ..... 131/215.2

OTHER PUBLICATIONS

Kanara, Mar. 8, 2011, http://www.thehookah.com/hookah-blog/hookah-news/new-kanara-mouth-tips-available-in-male-and-female.html.*

* cited by examiner

*Primary Examiner* — Richard Crispino
*Assistant Examiner* — Eric Yaary
(74) *Attorney, Agent, or Firm* — James M Smedley LLC; James M. Smedley, Esq.; Daniel Eisenberg, Esq.

(57) ABSTRACT

The present invention generally relates to mouth pieces for hookahs. Specifically, this invention relates to a mouth tip for a hookah that is constructed in a manner to allow for the hands free operation of the hookah. Embodiments of the present invention include a mouth tip or mouth piece for a hookah that comprises an oral attachment means configured to allow retention of the mouth piece in the mouth of a user without requiring the use of the hands of the user.

5 Claims, 4 Drawing Sheets

HANDS FREE HOOKAH MOUTH TIP

FIELD OF THE INVENTION

The present invention generally relates to mouth pieces for hookahs. Specifically, this invention relates to a mouth tip for a hookah that is constructed in a manner to allow for the hands free operation of the hookah. Embodiments of the present invention include a mouth tip or mouth piece for a hookah that comprises an oral attachment means configured to allow retention of the mouth piece in the mouth of a user without requiring the use of the hands of the user.

BACKGROUND OF THE INVENTION

The use of hookahs to filter and smoke tobacco and other inhalable substances has been commonplace for centuries. Most commonly, hookahs are used in social settings where multiple users take turns inhaling smoke from a flexible tube attached to the main hookah body.

In more recent times, removable sanitary mouth tips have been utilized to cover the portion of the hookah mouth piece that enters the mouth of a user. This helps to address the concern of passing saliva based bacteria, viruses and other unsanitary elements from user to user as the mouth piece is passed around.

One drawback of the use of a hookah is that it requires interaction and use of at least one of the hands of the user to operate. This requirement can limit or prevent the ability of the user to perform other tasks while operating the hookah. The only option to continue with other activities is to put the hookah mouth piece and tube down or to pass the mouth piece and tube to another person. This may not always be desirable as there is not always an appropriate surface for the mouth piece or another person to pass the tube to.

Another disadvantage of setting the mouth piece and tube down is that the mouth piece and tube may roll or otherwise not remain on the surface it is initially set on, creating the risk the mouth piece will come in contact with an unsanitary surface (e.g., the floor) or cause the spilling or tipping of the hookah itself as the weigh shifts. Tipping of the hookah can be particularly hazardous as it may cause the release of hot or flaming ash into the surrounding environment.

Therefore, there is a need in the art for a hookah mouth piece and/or mouth tip that allows for a user to operate the hookah without requiring the use of the hands of the user or requiring mouth piece to be set down when not in use. These and other features and advantages of the present invention will be explained and will become obvious to one skilled in the art through the summary of the invention that follows.

SUMMARY OF THE INVENTION

Accordingly, embodiments of the present invention are directed to providing a hookah mouth piece and/or mouth tip that allows for a user to operate the hookah without requiring the use of the hands of the user or requiring mouth piece to be set down when not in use.

According to an embodiment of the present invention, a hands free hookah mouth tip includes an elongated body portion, wherein said elongated body portion is configured to be placed over and retained upon a mouth piece of a hookah; and an oral retention means, wherein said oral retention means extends from an exterior portion of said elongated body portion, and wherein said oral retention means is configured to allow retention of the hands free hookah mouth tip upon one or more oral surfaces in such a manner as to allow for hands free operation of said hookah.

According to an embodiment of the present invention, the elongated body portion is comprised of a substantially hollow tube.

According to an embodiment of the present invention, the oral retention means is a ledge.

According to an embodiment of the present invention, the oral retention means comprises one or more wing shaped extensions.

According to an embodiment of the present invention, the oral retention means is a sloped edge.

According to an embodiment of the present invention, the oral retention means is a hooked arm.

According to an embodiment of the present invention, at least one of said one or more oral surfaces are teeth.

According to an embodiment of the present invention, at least one of said one or more oral surfaces are gums.

According to an embodiment of the present invention, at least one of said one or more oral surfaces is interior cheek flesh.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
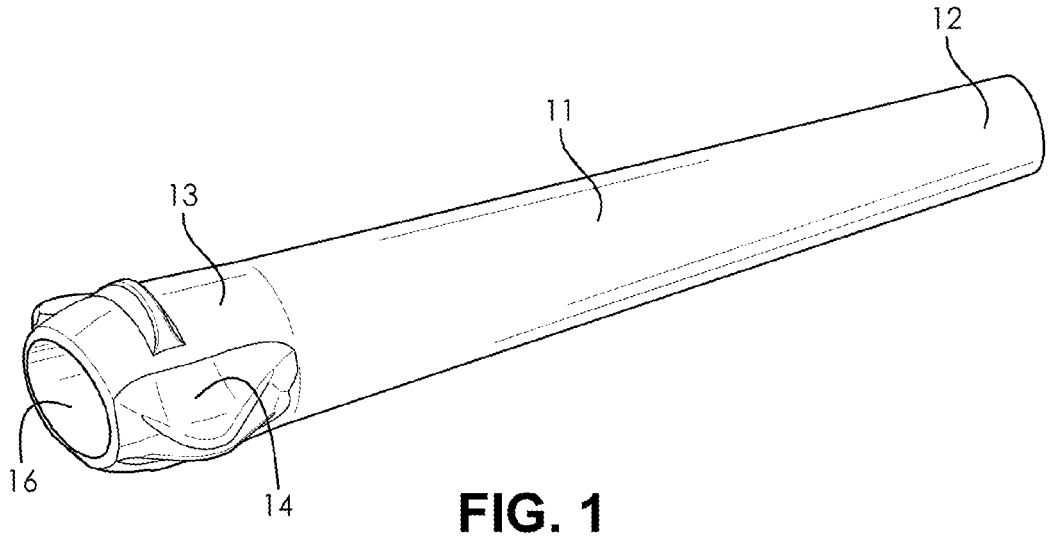
FIG. 1 is a perspective view of a hands free hookah mouth tip in accordance with an embodiment of the present invention.

The present invention generally relates to mouth pieces for hookahs. Specifically, this invention relates to a mouth tip for a hookah that is constructed in a manner to allow for the hands free operation of the hookah. Embodiments of the present invention include a mouth tip or mouth piece for a hookah that comprises an oral attachment means configured to allow retention of the mouth piece in the mouth of a user without requiring the use of the hands of the user.

According to an embodiment of the present invention, a hands free hookah mouth tip is comprised of an elongated body portion and an oral retention means. The hands free hookah mouth tip is configured to be retained over or inside a mouthpiece at the end of a hose portion of the hookah. In alternate embodiments of the present invention, a hands free hookah mouthpiece may be provided, whereby no replaceable mouth tip is required or utilized and the hands free functionality is provided by incorporating an oral retention means directly upon the hookah mouthpiece. In yet another embodiment of the present invention, a hands free hookah mouthpiece may be provided along with a hands free hookah mouth tip that is configured to fit over or inside the hands free hookah mouthpiece.

According to an embodiment of the present invention, the elongated body portion of the hands free hookah mouth tip is configured to slip over a mouthpiece of a hookah and be retained thereupon while in operation. In a preferred embodiment of the present invention, the elongated body is configured to be retained upon the mouthpiece by way of a force fit. In alternate embodiments, the elongated body may be retained upon the mouthpiece through any number of elongated body portion retention means, including, but not limited to, screw threads, hook and loop means, twist-lock means and clip on means. One of ordinary skill in the art would appreciate that there are numerous elongated body portion retention means that could be utilized with embodiments of the present invention and embodiments of the present invention are contemplated for use with any elongated body portion retention means. Finally, while the term elongated is used in relation to the body portion herein, the term is being used as a descriptive term and not one that is meant to limit or otherwise define the shape or dimensions of the body portion of the hands free hookah mouth tip. One of ordinary skill in the art would appreciate that there shape and dimensions of the elongated body portion may come in formats that may not otherwise be considered elongated.

According to an embodiment of the present invention, the oral retention means is comprised of one or more means for attaching, securing or otherwise retaining the hands free hookah mouth tip in or on one or more surfaces in the oral cavity of a user. In a preferred embodiment, the oral retention means may be one or more ledges extruding from one or more sides of the elongated body portion of the hands free hookah mouth tip. In this manner, the user can secure one or more of the ledges on one or more oral surfaces inside the user's oral cavity, such as behind his or her lower row of teeth. Once secured, the user can inhale smoke or other substances from the hookah at their convenience without the use of his or her hands and perform any other desired activity with their hands (e.g., play cards, utilize a computer, draw, paint).

In other embodiments of the present invention, the oral retention means may include, but are not limited to, one or more wings, one or more hooked arms and one or more sloped edges. One of ordinary skill in the art would appreciate that there are numerous types of oral retention means that could be utilized with embodiments of the present invention, and embodiments of the present invention are contemplated for use with any oral retention means.

According to an embodiment of the present invention, one or more wings may be used for design and ornamental purposes only. In these embodiments, the hands free hookah mouth tip may be comprised of both an oral retention means and one or more ornamental wings.

According to an embodiment of the present invention, the one or more oral surfaces the oral retention means may be attached to, secured to or otherwise retained upon may include, but are not limited to, cheeks, gums, teeth, lips and tongue. One of ordinary skill in the art would appreciate that there are numerous oral surfaces the oral retention means may be configured to attach to, secure to or otherwise be retained upon, and embodiments of the present invention are contemplated for use on or with any oral surface.

According to an embodiment of the present invention, the entire hands free hookah mouth tip may be constructed from one or more materials, including, but not limited to, plastic, wood, latex, ceramics, glass and vinyl. One of ordinary skill in the art would appreciate that there are numerous materials that could be utilized in the construction of embodiments of the present invention, and embodiments of the present invention are contemplated for use with any material.

Exemplary Embodiments

Figure 2:
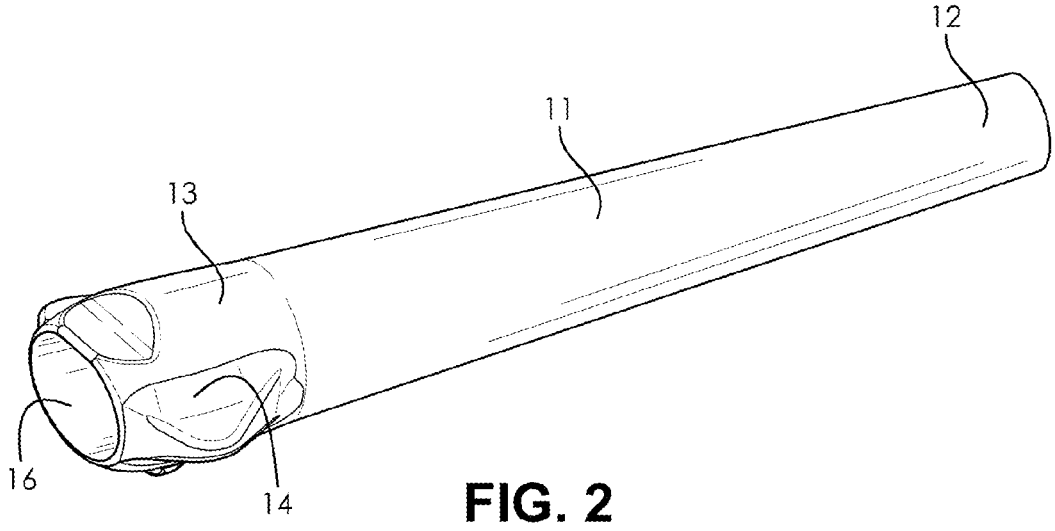
FIG. 2 is a perspective view of a hands free hookah mouth tip in accordance with an embodiment of the present invention.
Figure 3:
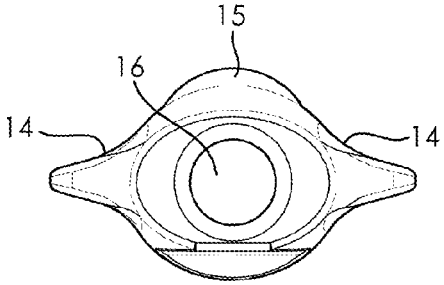
FIG. 3 is a front view of a hands free hookah mouth tip in accordance with an embodiment of the present invention.
Figure 4:
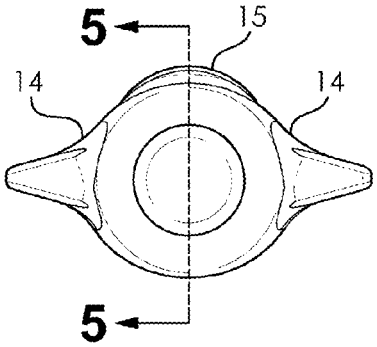
FIG. 4 is a rear view of a hands free hookah mouth tip in accordance with an embodiment of the present invention.
Figure 5:
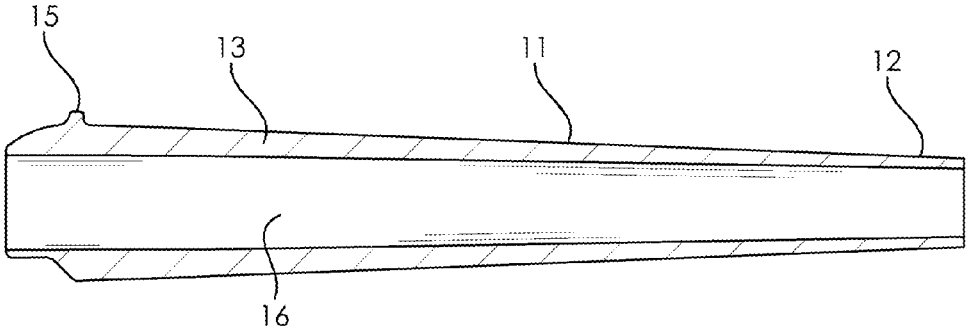
FIG. 5 is a side view of a hands free hookah mouth tip in accordance with an embodiment of the present invention.

Turning now to FIGS. 1-5, views of a hands free hookah mouth tip, in accordance with an embodiment of the present invention, are shown. In this view, an embodiment of the present invention is shown with an elongated body portion 11 extending in a smooth fashion from a rear end 12 to a front end 13. Integrally formed on front end 13 are oral attachment means in the form of two laterally extending wings 14 and a ledge 15 for retention upon one or more tooth. Formed in the front end and extending through the entire elongated body portion 11 is a cavity for the passage of smoke or other materials 16.

Figure 6:
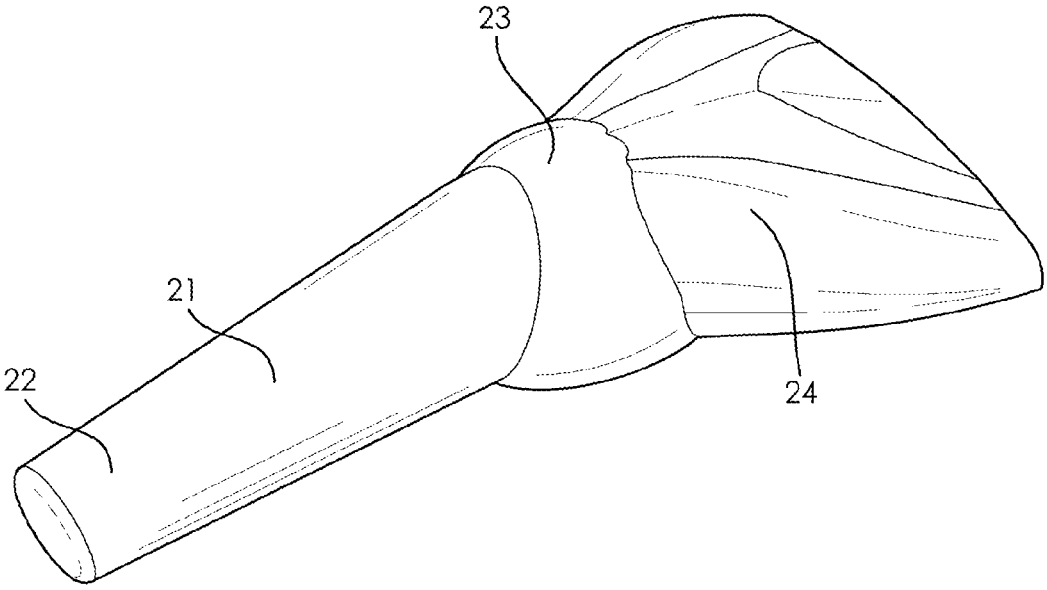
FIG. 6 is a perspective view of a hands free hookah mouth tip in accordance with an embodiment of the present invention.
Figure 7:
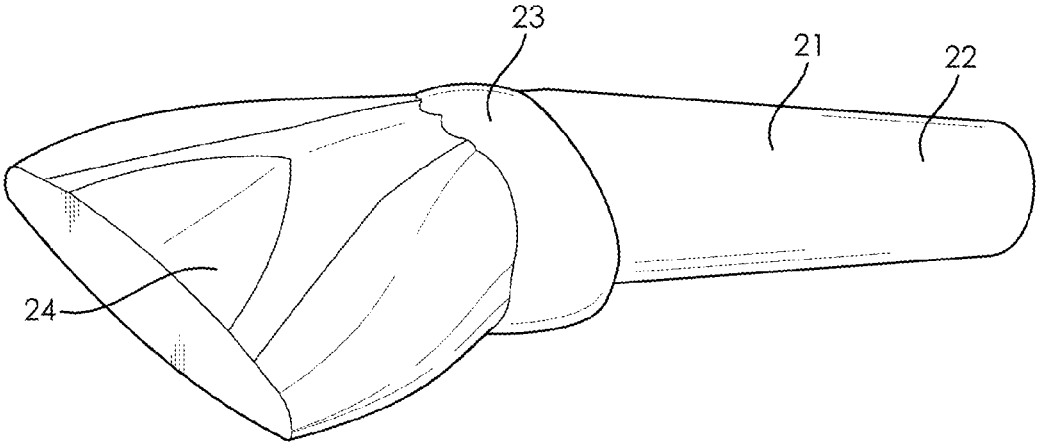
FIG. 7 is a perspective view of a hands free hookah mouth tip in accordance with an embodiment of the present invention.
Figure 8:
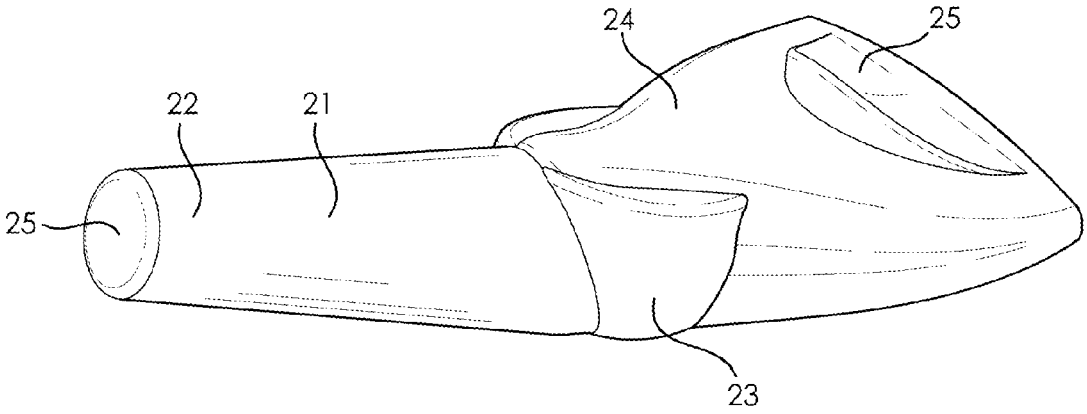
FIG. 8 is a perspective view of a hands free hookah mouth tip in accordance with an embodiment of the present invention.
Figure 9:
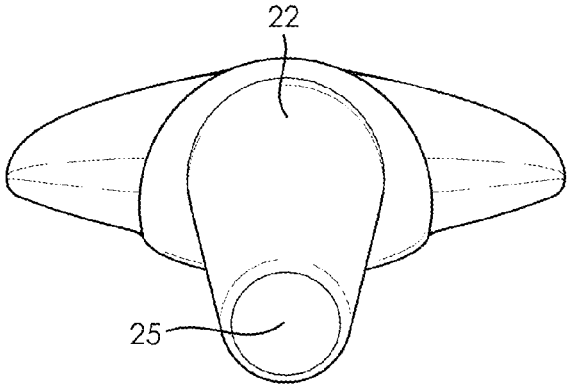
FIG. 9 is a rear view of a hands free hookah mouth tip in accordance with an embodiment of the present invention.
Figure 10:
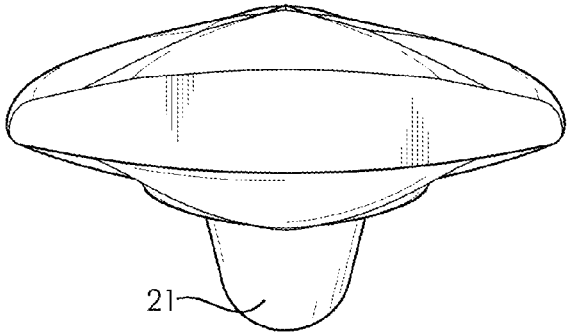
FIG. 10 is a front view of a hands free hookah mouth tip in accordance with an embodiment of the present invention.

Turning now to FIGS. 6-10, views of a hands free hookah mouth tip, in accordance with an embodiment of the present invention, are shown. In this view, an embodiment of the present invention is shown with an elongated body portion 21 extending in a smooth fashion from a rear end 22 to a front end 23. Integrally formed on front end 23 are oral attachment means in the form of a wide mouthpiece with a sloped edge 24 for retention upon one or more of a user's cheeks. Formed in the front end and extending through the entire elongated body portion 21 is a cavity 25 for the passage of smoke or other materials.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A hands free hookah mouth tip consisting of:

an elongated body having an internal circular cross section along its entire length defining a channel that extends along a single axis from one end of the elongated body to the opposite end, wherein said elongated body is uniformly cylindrical and substantially symmetrical about its longitudinal axis, wherein said elongated body is configured to be placed over and retained upon a mouth piece of a hookah; and an oral retention means disposed around the front outer surface of said elongated body, wherein said oral retention means comprises:

two laterally extending triangular wings, disposed opposite each other, a ledge disposed along an arcuate surface of said elongated body for retention of one or more teeth, said ledge disposed between said opposing wings, and a notch disposed opposite said ledge, between said opposing wings, wherein said oral retention means is configured to allow retention of the hands free hookah mouth tip upon one or more oral surfaces in such a manner as to allow for hands free operation of said hookah.

2. The hands free hookah mouth tip of claim 1, wherein said elongated body portion is comprised of a substantially hollow tube.

3. The hands free hookah mouth tip of claim 1, wherein said oral retention means comprises multiple ledges.

4. The hands free hookah mouth tip of claim 1, wherein at least one of said one or more oral surfaces is gums.

5. The hands free hookah mouth tip of claim 1, wherein at least one of said one or more oral surfaces is interior cheek flesh.

* * * * *